United States Patent [19]

Norden

[11] 4,066,323

[45] Jan. 3, 1978

[54] ELECTRICAL TERMINAL BLOCKS

[76] Inventor: Alexander R. Norden, 350 Central Park South, New York, N.Y. 10025

[21] Appl. No.: 739,782

[22] Filed: Nov. 8, 1976

Related U.S. Application Data

[62] Division of Ser. No. 542,293, Jan. 20, 1975, Pat. No. 4,027,937.

[51] Int. Cl.[2] ..... H01R 9/10; H01R 13/60; H01R 13/62

[52] U.S. Cl. ..... 339/126 R; 339/110 P; 339/198 P

[58] Field of Search ..... 339/91 R, 125 R, 126 R, 339/128, 198 R, 198 G, 198 GA, 198 H, 198 P, 110 R, 110 P

[56] References Cited

U.S. PATENT DOCUMENTS 3,130,921 4/1964 Morgan ..... 339/91 R X

*Primary Examiner*—Gerald A. Dost
*Assistant Examiner*—E. F. Desmond

[57] ABSTRACT

A terminal block is secured in position in an opening in a sheet-metal panel, with terminal screws extending at a small angle to the panel. Screw-driver thrust against the screws is resisted by engagement of the body of the terminal block against an edge of the opening. Resilient detents for holding the terminal block assembled to the panel are at the sides of the terminal block and are not affected by screw-driver thrust. The terminal block is locked to the panel along one edge of the opening by hooks extending from barriers between the circuit connectors. A circuit coding strip is carried by these hooks, useful in preliminary wiring and after the block is mounted on the panel.

One illustrative terminal block has plug-in contacts that are engaged by companion plug-in contacts of a plug-in unit. The body of the plug-in unit cooperates with detent-bearing portions of the stationary terminal block so as to block releasing deflection of the detents preliminary to engagement of the plug-in contacts and during the forcible completion of the plug-in operation. The plug-in unit has a shouldered projection that is received between parts of the stationary terminal block to establish preliminary alignment between both sets of plug-in contacts. The projection and its shoulder are separable from and cooperate as a fulcrum with mating stationary structure in a pivotal plug-in motion of the plug-in unit. One or more tapered cavities in the plug-in unit receive a screw driver which thereafter serves as a lever extension for forcibly pivoting the plug-in unit into or out of its plugged-in condition.

10 Claims, 16 Drawing Figures

FIG. 1
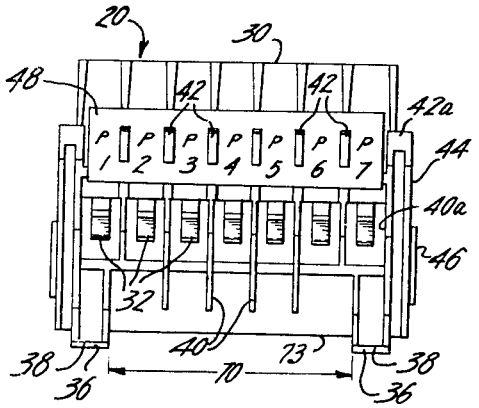
FIG. 2
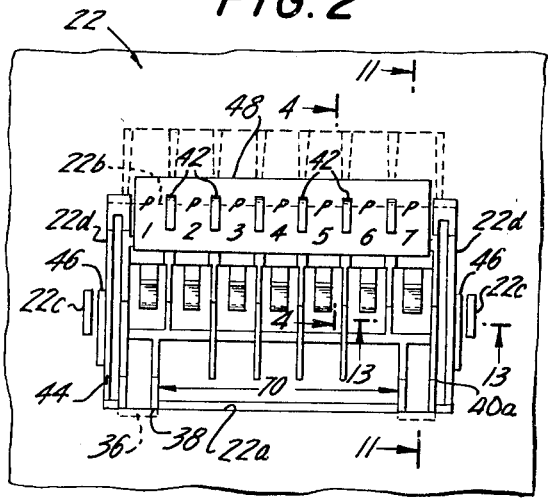
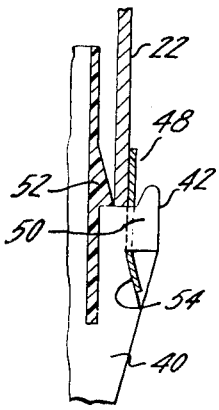
FIG. 4
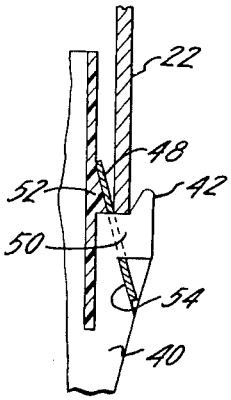
FIG. 5
FIG. 3
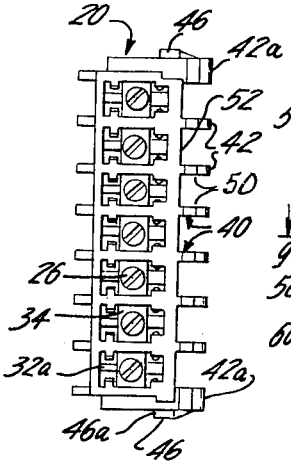
FIG. 6
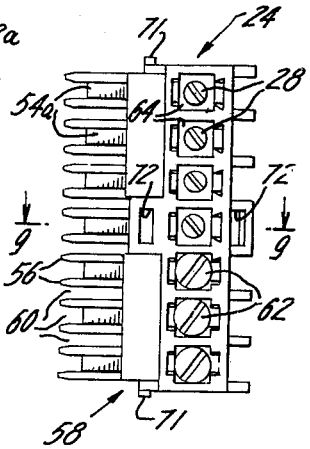
FIG. 7
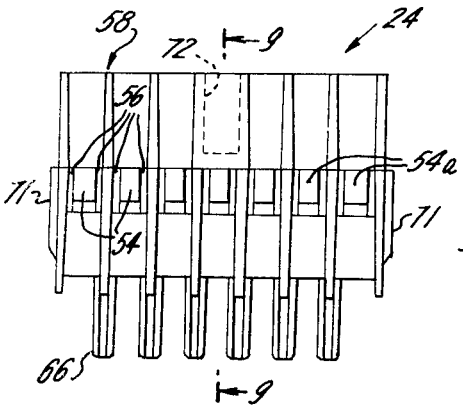
FIG. 8
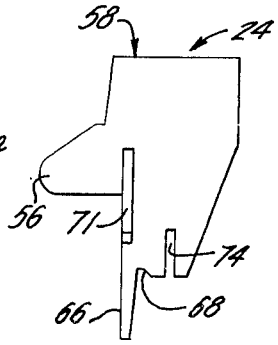
FIG. 9
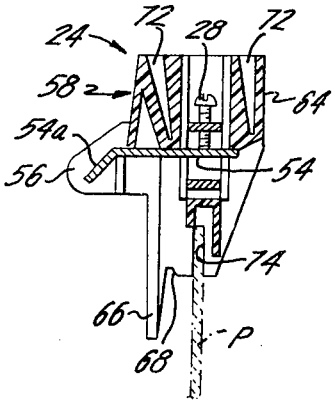

FIG. 10
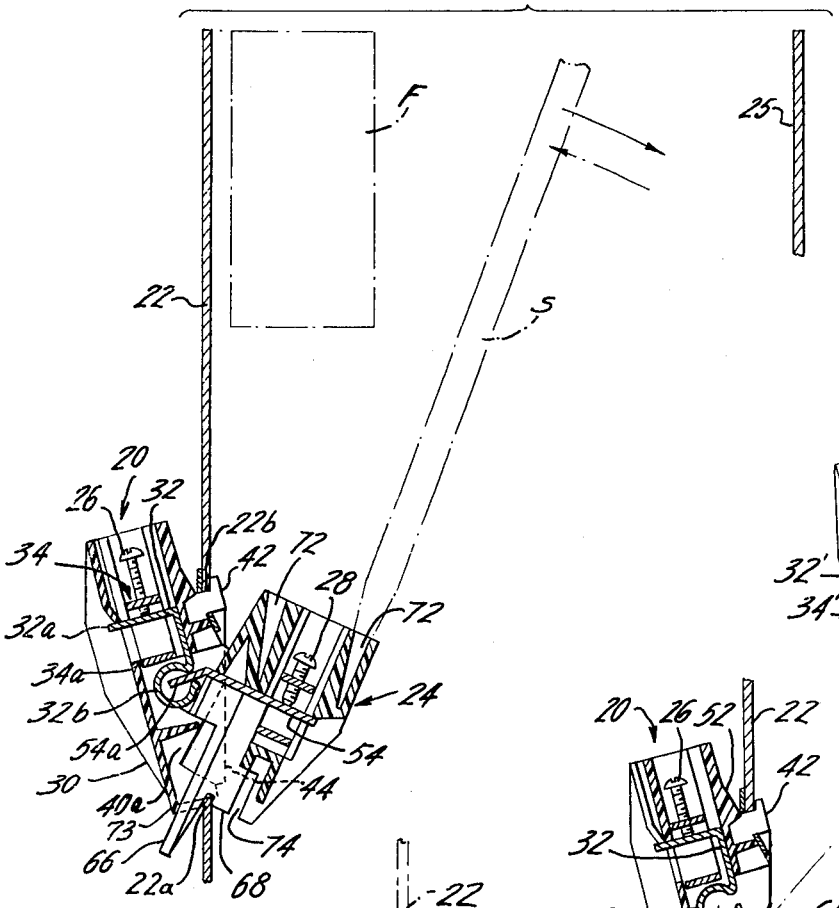
FIG. 16
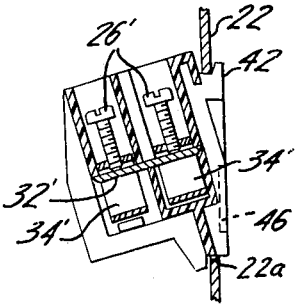
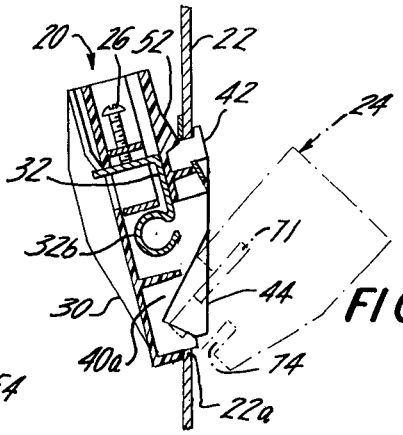
FIG. 11
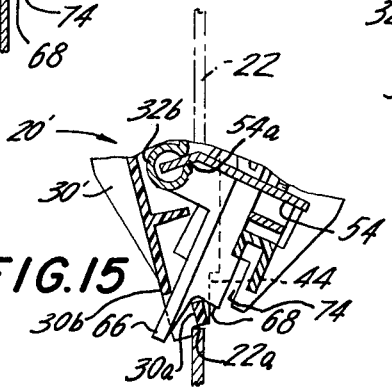
FIG. 15
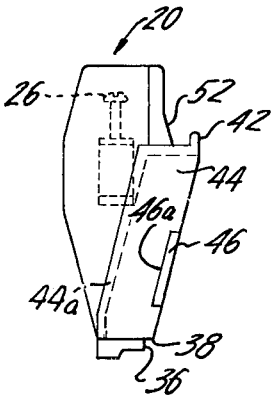
FIG. 12
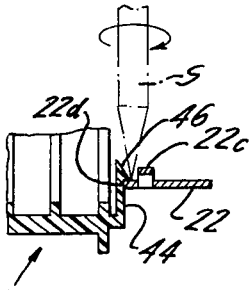
FIG. 13
FIG. 14
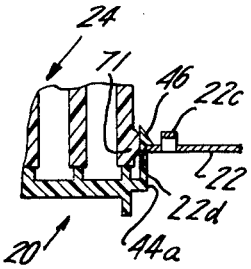

ELECTRICAL TERMINAL BLOCKS

This is a division of my application Ser. No. 542,293 filed Jan. 20, 1975, U.S. Pat. No. 4,027,937.

FIELD OF THE INVENTION

This invention relates to electrical terminal blocks and to companion plug-in units.

BACKGROUND OF THE INVENTION

Terminal blocks commonly have one or more circuit connectors. In case of a terminal block serving as a plug-in receptacle, the connector includes an electrical conductor having a wire-fastening terminal at one end and its opposite end is formed to act as a plug-in contact. Other terminal blocks include wire-fastening terminals at the opposite ends of a conductor. Commonly screws or screw-operated clamps are used as the wire fasteners. The present invention has various novel aspects that apply to terminal blocks having circuit connectors bearing two wire fasteners and to plug-in terminal blocks and plug-in units. This invention also has features applicable to plug-in connectors in particular, comprising a plug-in terminal block and a companion plug-in unit.

It has been proposed that terminal blocks having terminal screws (including binding-head screws, clamp-actuating screws and others) should be disposed for easy access where a first panel supports a terminal block and another panel is placed opposite the first so close to allow only a small space between the panels. As one step in meeting this requirement of limited access, it has been proposed that the terminal screws should be directed parallel to or at a small angle to the panel that supports a terminal block. It has also been proposed that the terminal block should be mounted in an opening in the panel, arranged to make circuit connections extending through the panel opening. In that case, the terminal block is to have a shoulder engaging an edge of the panel opening, and the terminal screw (or a row or rows of screws) advantageously is to be arranged on an insulating body so that screw-driver thrust against the screw(s) is directed at least approximately at the shoulder that bears against the panel opening. This arrangement avoids imposing screw-driver thrust against the terminal block in a way that would stress whatever means is provided for holding the terminal block assembled to the panel.

SUMMARY OF THE INVENTION

In the novel terminal blocks described below, an insulating body is provided with hook means for retentive engagement with an edge of an opening in a panel, and the insulating body can be swung about the edge and against the panel. Detent means retains the body in assembly to the panel, especially a pair of oppositely directed resilient detents cooperable with the margins along side edges of the panel opening. To special advantage, the resilient detents extend through the panel opening, and are integral portions of the insulating body of the terminal block.

The insulating body has a shoulder close to an edge of the panel opening opposite the edge engaged by the hook means. Terminal screws of the circuit connectors extend at least approximately toward one of those edges to provide reaction to operating thrust of a screw driver without imposing stress of the screw driver against the detent means.

The hook means in the illustrative terminal block is provided by a row of hooks extending from barriers projecting between the circuit connectors, where the terminal block has a row of circuit connectors. A circuit coding strip has apertures receiving the hooks. The coding strip is useful to guide an electrician in wiring a terminal block before the block is mounted on a panel. The circuit coding strip is confined between the hooks and the panel edge when the terminal block is received in the panel opening and the same strip then serves as a permanent code marker for the circuits.

The detents are shaped to provide locking faces to engage the panel surface, but the outward exposed faces of the detents slope so as to be cammed in the release direction when they are pressed against the edges of a panel opening when the terminal block is being assembled to the panel. At times it is important to remove the terminal block from the panel. For facilitating this operation, the panel in the illustrative embodiment has a struck-up abutment near but spaced from each detent. A screw driver can be pressed against the panel between such struck-up abutment and the nearby detent and then a twist of the screw driver will enforce releasing deflection of the detent so that the terminal block is freed and can be pushed out of the panel opening.

In the case of plug-in connectors, there is a plug-in unit that is to establish firm contact with plug-in contacts of the terminal block. The plug-in contacts move into mutual engagement along a line or lines extending through the panel opening. Where firm contact pressure is involved there may well be substantial stress tending to dislodge the detent means during the plugging-in operation. The novel plug-in unit has a blocking portion that is disposed closely adjacent to the detent means before and during mutual engagement of the plug-in contacts, preventing release of the detent means despite potentially large forces applied to the plug-in contact and transmitted against the terminal block in the direction that would drive the terminal block out of the panel opening if the detent means were overpowered and released. The detent blocking means of the plug-in unit prevents such release of the detents.

At one side of the insulating body of the plug-in unit in the illustrative embodiment of the invention described below there are two tapered cavities complementary to the blade of a screw driver. These cavities are formed in the side of the plug-in unit remote from a side where the plug-in unit has a separable pivot. When a screw driver is inserted into such a cavity, it acts as a lever extension of the plug-in unit to aid in driving the plug-in unit into or out of its plugged-in position. This is of special advantage where the enclosure in which the plug-in terminal block is mounted affords only limited access for applying pressure to the plug-in unit. The provision of plural arcuately separated cavities for a screw driver allows such cavities to be used successively for short operating strokes where the access space for the screw driver is severely restricted.

As already indicated, the illustrative embodiment of the plug-in unit has means providing a fulcrum, and the contacts of the plug-in unit move in an arc in the plug-in operation. A projection on the plug-in unit, and an adjoining shoulder, provide a guide establishing radial alignment of the moving plug-in contacts with the plug-in contacts of the stationary terminal block. The edge of the panel opening provides a pivotal axis although (at the expense of complicating the connector) the pivotal axis could be formed as part of the terminal block. Cooperating parts of the plug-in unit and the terminal block provide for preliminary lateral alignment of the plug-in contacts. In the illustrative embodiment, the same structure that arrests the detents of the stationary terminal block against release is utilized as this lateral alignment means. Moreover, there are insulating barriers on the plug-in terminal block and on the plug-in unit that separate the plug-in contacts of each circuit connector from its neighbors, and the lateral alignment means facilitates meshed assembly of those insulating barriers.

A further novel feature of the illustrative plug-in unit promotes easy wiring. The circuit wires extend from an enclosure in which the plug-in terminal block is mounted. Taking advantage of the ready availability of a sheet-metal edge on or near such enclosure, the plug-in unit has a relatively narrow and deep groove extending into the insulating body at the side thereof remote from the terminal screws and parallel to the row of screws. The terminal block then can be supported on the edge of an available sheet-metal part during wiring of the plug-in unit.

The various novel features of the invention outlined above are embodied in the illustrative plug-in connector shown in the accompanying drawings and described in detail below. Certain of the novel features may well be used without others, and they may be adapted to other forms of wiring devices without departing from the spirit of the invention. The nature of the invention including its various novel features and their advantages will be better understood from the following detailed description of the illustrative embodiment.

In the drawings:

FIG. 1 is a front elevation of a plug-in terminal block, showing its plug-in contacts;

FIG. 2 is a view of the plug-in terminal block of FIG. 1, seen from the same direction, assembled to a supporting sheet-metal panel;

FIG. 3 is the top plan view of the plug-in terminal block of FIG. 1;

FIG. 4 is an enlarged detail in FIG. 2 shown in cross-section as viewed at the plane 4—4 in FIG. 2;

FIG. 5 is a modified arrangement of the parts of FIG. 4;

FIG. 6 is the top plan view of a plug-in unit for plug-in assembly with the terminal block of FIGS. 1–4, the plug-in unit of FIG. 6 being shown in alignment with the terminal block of FIG. 3;

FIG. 7 is a front elevation of the plug-in unit of FIG. 6, showing the plug-in contacts;

FIG. 8 is an elevation of the plug-in unit of FIGS. 6 and 7, from the right-hand end of FIG. 7;

FIG. 9 is a cross-section of the plug-in terminal block of FIGS. 6–8, as viewed from the plane 9—9 in FIG. 7, the plug-in unit being supported temporarily on a sheet-metal part shown in phantom lines;

FIG. 10 is a cross-sectional view of the plug-in terminal block of FIGS. 1–4 and the plug-in unit of FIGS. 6–9 in plug-in assembly with each other, together with sheet-metal parts of a typical enclosure in which the plug-in connector is used, further showing an obstruction often forming part of the enclosure and a screw driver used as an aid in plugging-in and removing the plug-in unit, the obstruction and the screw driver being shown in phantom lines;

FIG. 11 is a cross-section of the assembly of FIG. 2 as viewed from the plane 11—11 therein and including a plug-in unit in phantom lines, at an initial phase of its insertion;

FIG. 12 is an end view of the plug-in terminal block of FIGS. 1–4 as viewed from the left of FIG. 1;

FIG. 13 is a fragmentary cross-section of the plug-in terminal block and its supporting sheet-metal panel as viewed from the plane 13—13 in FIG. 2, including a screw-driver in phantom lines;

FIG. 14 is a view as in FIG. 13, additionally including the plug-in unit of FIGS. 6–9, shown fully inserted;

FIG. 15 is a fragmentary view like FIG. 10 of a plug-in unit in assembly with a modified plug-in unit; and FIG. 16 is a view like FIG. 11 of a modified terminal block.

Referring now to the drawings, the illustrative plug-in terminal block 20 appears separately in FIGS. 1, 3 and 12, and this plug-in terminal block is shown assembled to a sheet-metal panel 22 in FIGS. 2, 4, 5, 11, 13 and 14. The companion illustrative plug-in unit 24 appears separately in FIGS. 6, 7, 8 and 9, and it appears in phantom lines in FIG. 11. Both the terminal block 20 and the plug-in unit 24 appear in plugged-in assembly in FIGS. 10 and 14 as a connector, together with sheet-metal panel 22. In FIG. 10, sheet-metal panels 24 and 25 form part of a sheet-metal enclosure containing electrical apparatus (not shown) that is to be wired. The connector provides a means for making readily separable connections for multiple wires, either between different parts of the contained electrical apparatus or between the contained electrical apparatus and external circuits.

As seen in FIG. 10, the parts 20 and 24 of the connector have wire fasteners that include screws 26 and 28, respectively. Each of the axes of the screws 26 of terminal block 20 extends at a small angle to panel 22, and therefore these screws are accessible for operation by a screw driver if it should become necessary to tighten or release an inserted wire, where the screw driver is directed downward in FIG. 10 at a small angle to panel 22. Panel 22 and other parts of the enclosure inhibit convenient access to wire-securing screws from other angles. Thus, the enclosure would prevent easy access to the wire-securing screws of a more conventional terminal block having wire-securing screws extending perpendicular to panel 22. No broad novelty is claimed for terminal blocks having such angled wire-securing screws for promoting easy operating access.

As seen in FIGS. 1, 3 and 10, plug-in terminal block 20 includes a body 30 of molded insulation such as nylon, supporting and containing conductors 32 each shaped at one end to provide a female plug-in contact **32*b*. Screw 26 is threaded into the top wall of a rectangular clamp 34 for each conductor 32. A wire, or occasionally plural wires, can be inserted between terminal portion 32*a* of conductor 32 and wall 34*a* of the clamp, to be gripped securely upon tightening of screw 26. Screw fastener 26, 34 and contact 32*a* for making one circuit connection and conductor 32 *b* for making another circuit connection and conductor 32 are here collectively called "a circuit connector", being all the parts for making one circuit connection. Thus, in FIG. 1 terminal block 20** has seven "circuit connectors".

The clamp form of fastener for a wire is illustrative. As one other alternative, a simple wire-binding screw may be used, where the screw-head tightens to wire against the conductor (32). Moreover, in practice the terminal block itself takes the form of a complete connector in another application of certain aspects of the invention, omitting plug-in unit 24. For example (FIG.

16), two clamps 34' and clamp operating screws 26' or other wire fasteners may be provided at the ends of a conductor 32' (retaining parts 42, 46, etc.) as a circuit connector for joining two wires.

Plug-in terminal block 20 is formed to include surfaces 36 and shoulders 38, for engaging the face and the edge, respectively, of panel 22, at an opening proportioned to admit the terminal block. As seen in FIG. 2, shoulders 38 rest against one edge 22*a* of a rectangular opening in panel 22.

Conductors 32 are suitably supported in respective cavities in body 30, formed in part by barriers 40. These barriers have projecting hooks 42. Each end wall 44 of body 30 together with the adjacent barrier 40 are unified at their upper edges where there is a wider hook 42*a*. Each wall 44 and the adjacent barrier are also unified at their rear edges as parts of body 30. End walls 44 are resilient and bear respective ribs 46. Each rib has a shoulder 46*a* (FIG. 12) that is to bear against a sheet-metal panel. The opposite or outer surfaces of ribs 46 slope in relation to the plane defined by abutment surfaces 36 and abutment portions 52 of body 30 (FIG. 4) behind hooks 42. The angle of the sloping surfaces, about 45° in an example, is made suitable for the sloping surface to act as a cam in cooperating with the lateral edge of a panel opening, to flex end walls 44 inward when body 30 is being forced into full assembly with a panel opening. End wall and rib 46 form a resilient detent for holding block 30 in the panel opening, so that block 30 has a pair of oppositely directed detents. These detents extend along sides of block 30 and are essentially unaffected by thrust applied to screws 26.

Body 30 of terminal block 20 is mounted on a panel 22 in the following manner. Hooks 42 are inserted in the panel opening and engaged over edge 22*b* of the panel, and then body 30 is swung about edge 22*b* until the outer cam surfaces of ribs 46 bear against edges of the panel. Applying firm force against body 30 forces end walls 44 to flex inward, so that ribs 46 snap over the lateral edges of the panel opening. At this point, shoulders 38 are closely adjacent the bottom edge 22*a* of the panel opening so as to restrain body 30 against shifting downward, and surfaces 36 confront the rear of the panel. Portion 52 of body 30 (FIG. 12) opposite hooks 42 limits forward shift of body 30 into the panel opening.

Hooks 42 and ribs 46 retain body 30 in assembly to panel 22. Shoulders 38 are well suited to resist or provide reaction to thrust applied to screws 26 when tightening or loosening those screws. Little if any of this thrust is imposed against hooks 42 and detents 44, 46.

Panel 22 has lanced-out abutments 22*c* adjacent ribs 46, for facilitating removal of terminal block 20 from panel 22. A screw driver can be applied to the face of panel 22 between rib 46 and abutment 22*c* (FIG. 13); and when the screw driver is twisted, rib 46 on flexible wall 44 is forced to clear the lateral edge 22*d* of the panel opening. Slight rearward pressure swings body 30 about hooks 42 and frees the body for removal from the panel.

As shown in FIG. 1, a circuit coding strip 48 as of flexible plastic has a series of openings that receive hooks 42 and tightly admit the necks 50 under the hooks 42. Coding strip 48 has a series of circuit labels "P-1", "P-2", etc. aligned with the respective circuit connectors, each comprising a conductor 32, its plug-in contact 32*b*, and its wire fastener consisting of wire-securing screw 26 and clamp 34. Before terminal block 20 is mounted on panel 22, it is advantageous to apply strip 48 to the terminal block, and to wire the terminal block. Then strip 48 may be removed, using some force where the fit is tight. Terminal block 20 is forcibly inserted into the panel opening and locked in place by ribs 46 snapping over lateral edges 22*d* of the panel opening. There is clearance between hooks 42 and the opposed abutment portion 52 of body 30, enough clearance to enable strip 48 to be slipped forcibly over hooks 42 and onto necks 50, as shown in FIG. 4. In that condition the label strip is flexed by enforced positioning of its upper half between panel 22 and hooks 42 while its lower half is forced outward by engaging a sloping portion 54 of each barrier 40 below each hook 42. The enforced flexed condition of strip 48 supplements the action of hooks 42 in securely retaining label strips 48 in position. Label strips 48 can thus serve for circuit identification both before and after the terminal block has been mounted on a panel.

As an alternative to the label mounting configuration of FIG. 4, it is seen in FIG. 5 that label strip 48 need not be removed from the terminal block after being used in wiring the terminal block. With the circuit coding strip 48 on body 30 as shown in FIG. 1, the upper half of strip 48 can be tucked behind panel 22 as hooks 42 are engaged in front of the panel. While part of the coding strip is concealed in this arrangement, that would be of no consequence where the strip has sufficient area exposed through the panel opening for the required circuit designations.

As noted above, terminal block 20 may be modified by adding a second wire-securing device such as a screw and clamp to each wire securing device 26, 34 shown, correspondingly, omitting plug-in contact 32*b*. Such added screw and clamp are shown in FIG. 16, where screws 26' and clamps 34' cooperate with conductor 32'. Screws 26' are all exposed for operation from above. The stress developed against body 30 when any of the screws is operated (both as to the plug-in terminal block and the modification) is directed toward the lower edge 22*a* of the panel opening; and in that case, locking ribs 46 are largely or wholly immune to such stresses, and remain fully effective to hold body 30 in its installed position in the panel opening. Should it become necessary to remove terminal block 20 (or the modification of FIG. 16) a screw driver is applied to panel 22 between rib 46 and the adjacent abutment 22*c* (FIG. 13) and the screw driver is twisted, thereby flexing the wall 44 that supports rib 46, enabling each end of body 30 to be pushed out of the panel opening.

FIGS. 6–9 show an illustrative plug-in unit 24 that mates with plug-in terminal block 20. Each male plug-in contact 54*a* is disposed between a pair of barriers or insulating walls 56 (see especially FIG. 6) projecting integrally from body 58 of insulation such as nylon. Spaces 60 are provided between successive pairs of barriers 56. Contacts 54*a* are distributed at positions to be aligned with contacts 32 of the terminal block 20, and spaces 60 are distributed at positions to receive barriers 40 of terminal block 20. Wire-securing screws 62 may be threaded into conductors 54, or wire-securing clamps 64 may be operated by screws 28 to tighten an inserted wire against respective conductors 54. Each wire fastener and the conductor that provides plug-in contact 54 form a circuit connector of the plug-in unit.

Block or body 58 has a series of projections 66 and an adjoining shoulder 68. The lateral extent of projections 66 (collectively) is such as to fit the space 70 (FIGS. 1 and 2) between portions of body 30 which bear surfaces 36 and 38. When projections 66 are inserted into space 70 of a terminal block 20 on a panel 22, shoulder 68 rests on the same lower edge 22a of the panel opening that abuts terminal block shoulders 38. In this condition, barriers 40 of the terminal block are aligned with spaces 60 between pairs of barriers of the plug-in unit, each male contact 54a is aligned laterally and arcuately with a respective female contact 32, and ribs 71 at the ends of body 58 are disposed closely adjacent the inside surfaces of end walls 44 of the terminal block. At this point, and before any arcuate plugging-in motion (see FIGS. 11 and 14), end walls 44 are blocked against any such inward flexing movement as might release ribs 46 from their locking contact with panel 22. Consequently, when the male plug-in contacts 54a subsequently are driven forcibly into tightly gripping female contacts 32b, that force cannot dislodge the terminal block from the panel.

Counterclockwise pivoting of unit 24 is complete when the parts are related as shown in FIG. 10. A substantial effort may be needed to enforce this operation, particularly when there is firm contact pressure between the plug-in contacts, where the contacts are large, and where there are many pairs of plug-in contacts. The space or access for a person's hands to apply plugging-in pressure may be restricted, as by a frame F and by a panel 26 close to panel 22. Body 58 is here formed with a pair of sockets 72 at different arcuate locations in relation to the arcuate fulcrum defined at the junction of projections 66 and shoulder 68. One of these sockets can be engaged by a screw driver and operated through an angle in the direction of the broken-line arrow in FIG. 10, for easily achieving the plug-in operation. Both sockets may be used in succession where the operating angle of the screw driver is small, as limited by close spacing of panels 22 and 26. The same sockets and screw driver are effective in easily extracting the plug-in unit from its plugged-in condition shown in FIG. 10, by operating screw driver S in the direction represented by the solid line arrow.

Individual screws may be forcibly turned for tightening or releasing a wire of plug-in unit 24 in its plugged-in condition. However, it is more practical to wire the whole unit before it is plugged in. A slot 74 (FIG. 8) is formed in body 58, parallel to the row of screws and opening in the direction opposite to the exposure of the screw heads so that an electrician who is to wire the unit can support unit 24 on an edge of any available panel P, which enters slot 74. Such a panel is commonly at hand in situations where such connectors are to be installed. Panel P in slot 74 resists tilting of unit 24, and since the plane of panel P includes a line perpendicular to (if off-set from) the screw axes, it resists the tendency of the plug-in unit to turn when screws 28 and 62 are tightened. Slot 74 thus provides an important adjunct of the plug-in unit, greatly facilitating the wiring operation.

The plug-in terminal block and plug-in unit of FIGS. 1–14 incorporate various distinctive features, some of which may be used without others and some of which may be modified. For example, what may be called a "fixed-circuit" terminal block (for want of a better term) as shown in FIG. 16 and described above retains some of the novel features found in the plug-in terminal block 22. Further, while certain advantages of the terminal block and plug-in unit relate to screw-type wire fasteners, screw-less fasteners for bare wires or for wires with fittings such as spring clips have their usefulness with many of the disclosed novel features not related to the use of screws. In addition, while it has been indicated that the plug-in unit cooperates with an edge 22a of the panel opening as a fulcrum, that fulcrum could be incorporated in the terminal block as shown in FIG. 15. In the form shown there, insulating body 30' includes a transverse bar 30a carried at its end by transverse walls and separated by a slot from wall 30b. Projections 66 of the plug-in unit and the adjoining shoulder 68 cooperate pivotally with bar 30a during a plug-in operation. Bar 30a forming part of a modified terminal block 20' thus replaces edge 22a of the panel opening as the pivotal fulcrum.

The dimension of plug-in unit 24 between shoulder 68 and the uppermost end of insulating block 58 may be made small, as shown, and yet a large amount of leverage is developed by screw driver S (FIG. 10) when plug-in and removal effort is to be applied to unit 24. If only a few contacts 54a were involved, or if the contacts were small so as to offer little mechanical resistance to applied plug-in effort, it would not be important to use screw-driver S (FIG. 10) for added leverage. If only a modest amount of added leverage were desired (additional to that developed by pushing directly against block 58) then block 58 could be formed with a short integral lever extension replacing the separable lever extension represented by screw-driver S.

The foregoing and other variations in the plug-in connectors described in detail above are contemplated modifications. Still others will be obvious to those skilled in the art. Consequently, the invention should be given broad construction, in accordance with its full spirit and scope.

What is claimed is:

1. In combination, a terminal block and a companion plug-in unit having cooperable electric contacts, said plug-in unit being wholly separable from said terminal block, said plug-in unit having a separable hinge formation adapting the plug-in unit for pivotal operation about a fulcrum into plugged-in engagement with and removal from said terminal block, said plug-in unit having means for establishing unitary cooperation with an elongated tool which then becomes a lever extension of the plug-in unit providing leverage about said fulcrum to aid in insertion of the plug-in unit into plugged-in assembly with the terminal block and to aid in extraction of the plug-in unit from such assembly, said means for establishing unitary cooperation with such tool including a tool-engagement formation adapted to mate with a complementary formation of the tool in such a manner that the tool and the plug-in unit form an elongated member operable about the fulcrum.

2. The combination in accordance with claim 1 wherein said formation is shaped to provide an inwardly tapered cavity for securely receiving the blade of a screw-driver.

3. The combination in accordance with claim 1, including at least an additional formation as aforesaid, said formations being separated from each other angularly about the fulcrum, for cooperation with a tool in successive angular operations of the plug-in unit.

4. The combination in accordance with claim 3, wherein each said formation is shaped to provide an inwardly tapered cavity for securely receiving the blade of a screw-driver.

5. A plug-in electrical connector including stationary terminal block means and a terminal block unit adapted for plug-in assembly to and separation from said stationary terminal block means, each of said terminal block means and said terminal block unit having a base of insulation and having a row of circuit connectors carried by said base, said stationary terminal block means including means for fixedly supporting said base of insulation thereof, each said circuit connector including a terminal for connection to an external circuit, a wiping contact and a connection between the terminal and the wiping contact; said wiping contacts of the circuit connectors of said terminal block means and said terminal block unit being disposed in respective rows for mutual cooperation as companion pairs of wiping contacts and the movable said row of contacts being operable along sliding paths while in wiping contact with corresponding contacts of the other row during assembly and separation of said terminal block unit to said stationary terminal block means; barrier formations of insulating extending from at least one of said bases disposed between the pairs of companion contacts in the assembled state of the terminal block means and the terminal block unit; said terminal block unit and said stationary terminal block means having readily separable fulcrum means brought into mutual cooperation incidental to their being assembled, said fulcrum means being spaced from said companion contacts and offset from said sliding paths of said movable contacts for adapting said terminal block unit to be moved angularly about the fulcrum means in relation to said terminal block means for effecting sliding operation of movable row of contacts in relation to the other row of contacts; and said terminal block unit having means enabling development of leverage about said fulcrum means with an effective length of lever greatly in excess of the radius between the fulcrum means and all of the wiping contacts of the plug-in electrical connector for effecting enforced angular movement of the movable row of contacts while in wiping contact with the contacts of the other row.

6. A plug-in electrical connector in accordance with claim 5, wherein said bases of insulation include cooperable portions constituting said fulcrum means.

7. A plug-in electrical connector in accordance with claim 5, further characterized in that each of said connections of the circuit connectors of both said terminal block means and said terminal block unit is a unitary conductor extending to and integrally forming at least part of the terminal and the wiping contact of its respective circuit connector.

8. A plug-in electrical connector in accordance with claim 5 wherein at least one of said bases of insulation is a housing containing its corresponding row of circuit connectors and having integrally projecting barriers constituting at least part of said insulating barrier formations.

9. A plug-in electrical connector in accordance with claim 5, wherein said supporting means includes a panel for supporting the base of insulation thereof, and wherein a portion of said panel constitutes part of said fulcrum means.

10. A plug-in electrical connector in accordance with claim 5 wherein said means for development of leverage comprises at least one tool-engagement formation adapted to mate with a complementary formation of an elongated tool in such a manner that the tool and the plug-in unit form an elongated unitary member operable about said fulcrum means.

* * * * *